US005950796A

United States Patent [19]

Kobayashi

[11] Patent Number: 5,950,796

[45] Date of Patent: Sep. 14, 1999

[54] APPARATUS FOR MEASURING A DIAMETER OF A DISK BODY

[75] Inventor: Yushiro Kobayashi, Iwatsuki, Japan

[73] Assignee: Asahi Seiko Kabushiki Kaisha, Tokyo, Japan

[21] Appl. No.: 08/838,626

[22] Filed: Apr. 11, 1997

[30] Foreign Application Priority Data

Apr. 12, 1996 [JP] Japan ..... 8-126241
Apr. 26, 1996 [JP] Japan ..... 8-142114

[51] Int. Cl.[6] ..... G07D 5/02

[52] U.S. Cl. ..... 194/337; 453/4

[58] Field of Search ..... 194/334, 337; 453/3, 4, 33, 49, 57

[56] References Cited

U.S. PATENT DOCUMENTS

| | | | |
|---|---|---|---|
| 3,371,761 | 3/1968 | Hirano | 194/334 |
| 3,680,566 | 8/1972 | Tanaka et al. | 453/4 |
| 4,998,611 | 3/1991 | Shuie | 194/337 |
| 5,097,934 | 3/1992 | Quinlan, Jr. | 194/200 |
| 5,480,348 | 1/1996 | Mazur et al. | 453/57 X |

FOREIGN PATENT DOCUMENTS

| | | | |
|---|---|---|---|
| 5-45104 | 2/1993 | Japan . | |
| 6-150102 | 5/1994 | Japan | 453/57 |
| 1 390 143 | 4/1975 | United Kingdom . | |
| 2 226 678 | 7/1990 | United Kingdom . | |
| WO 90/06070 A1 | 6/1990 | WIPO . | |

*Primary Examiner*—F. J. Bartuska
*Attorney, Agent, or Firm*—McGlew and Tuttle, P.C.

[57] ABSTRACT

An apparatus is provided including at-least a fixed member for guiding a pushed-out disk body and a movable member which moves in a direction opposing the fixed member and becomes free in the contact with the pushed-out disk body. An elasticity member is provided for drawing this movable member to the direction of the fixed member, and detection device is for detecting the movement of the movable member. A signal handling device is provided for processing a signal from the detection device and for measuring the diameter of the disk body. A rotating body is provided for pushing out a disk body. An angle of rotation detection device may also be provided for detecting the rotation angle of the rotating body.

18 Claims, 4 Drawing Sheets

APPARATUS FOR MEASURING A DIAMETER OF A DISK BODY

FIELD OF THE INVENTION

This invention relates to an apparatus for measuring a diameter of the disk body such as a coin or token with disk form or a medal with disk form which is used for games and more particularly to a disk body diameter measurement apparatus which is suitable for the use with coin selecting parts which are disposed in a vending machine, a change machine and so on.

BACKGROUND OF THE INVENTION

Various techniques are known from the past for measuring the diameter of disk body such as coins tokens and the like. These include:

1) The use of a potted core for detecting the influence of the coin on a magnetic filed, (detecting oscillations of a magnetic field). Such arrangements can be devised and calibrated to judge the diameter of the coin from the data which the arrangement provides;
2) The use of light detecting arrangements for detecting the quantity of the light which is interrupted by the disk body to measure the diameter of such disk body;
3) The use of a moving arm toward a diameter direction of disk body, and measuring the diameter according to the movement quantity thereof. Such an arm movement apparatus which moves an arm to a diameter direction of disk body and measures the diameter in the movement quantity thereof is concretely disclosed in the specification of Japanese Patent Disclosure 5-45104.

This disclosed apparatus makes a measurement member touch the circumference edge of the coin which moves along the reference surface. Then, this apparatus converts the rotated angle of the measurement member into a change of the resistance value through a gear apparatus and measures the diameter of the moved coin depending on a changed pattern with this resistance value.

However, in the above mentioned way of measuring a diameter of disk body, there is a problem of the requirement for substantial installation space of the measurement apparatus, or the need to provide a distance of the natural fall of the disk body such as the coin, etc.

SUMMARY AND OBJECTS OF THE INVENTION

It is an object of the invention to provide a small and simple diameter measurement apparatus, particularly for coins tokens, medals and similar disk elements.

In is a further object of the invention to provide a device for use with the coin selecting portion which is disposed in the vending machine or the change machine and the like even when the normally required sufficient space is not available or it isn't possible to take a gap distance to make a coin fall naturally by gravity.

It is still another object of the invention to provide an apparatus which is intended for the purpose to make the measurement of a disk body diameter using a coin ejecting apparatus, a device that includes an actuator which calculates the number of pushed out coins and snaps or otherwise moves the concerned coins outside.

According to one aspect of the invention, the apparatus comprises at-least a fixed member for guiding a pushed-out disk body, a movable member which moves in a direction opposing the fixed member and becomes free in the contact with the pushed-out disk body. An elasticity member is provided for drawing this movable member to the direction of the said fixed member, and detection means for detecting the movement of the said movable member. Also, the apparatus according this invention includes signal handling means for processing a signal from the detection means and for measuring the diameter of the said disk body.

According to another aspect of the invention, the apparatus comprises a rotating body for pushing out a disk body as well as angle of rotation detection means for detecting the rotation angle of the rotating body. A fixed member is provided for guiding the disk body which is pushed out. A movable member is provided which moves opposite to the fixed member and becomes free from contact with the disk body upon it being pushed out. An elasticity member is provided for drawing or biasing this movable member to the direction of the fixed member. Movement detection means for detecting the movement of the movable member is also provided.

Also, an apparatus of the invention includes signal processing means for processing signals to measure the diameter of the disk body is provided. A microprocessor or central processing unit handles signals from angle of rotation detection means and the movement detection means.

The apparatus of the invention may be provided with a fixed member having a small roller. The apparatus of the invention may be provided with a movable member having a small roller.

In addition, the apparatus of the invention may be provided with a detection means having a photosensor.

Therefore, the diameter measurement apparatus of this invention provides a detection means which includes a simple constitution of the slits and photosensor and the like in combination with structure of a coin actuator and the like. Further, the apparatus of this invention can simply measure the diameter of the disk body which is pushed out, by the calculation of the number of the pulses which is gotten by the detection means. Moreover, it is possible to make the slits narrower to provide a more precise measurement, namely an increase in the number of the pulses which is provided by this detection means as it moves.

Also according to this invention, the big advantage that the whole apparatus becomes small and simple is achieved. This is because the constitution to add is very simple.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS In the drawings.

DESCRIPTION OF THE PREFERRED EMBODIMENTS

Figure 1:
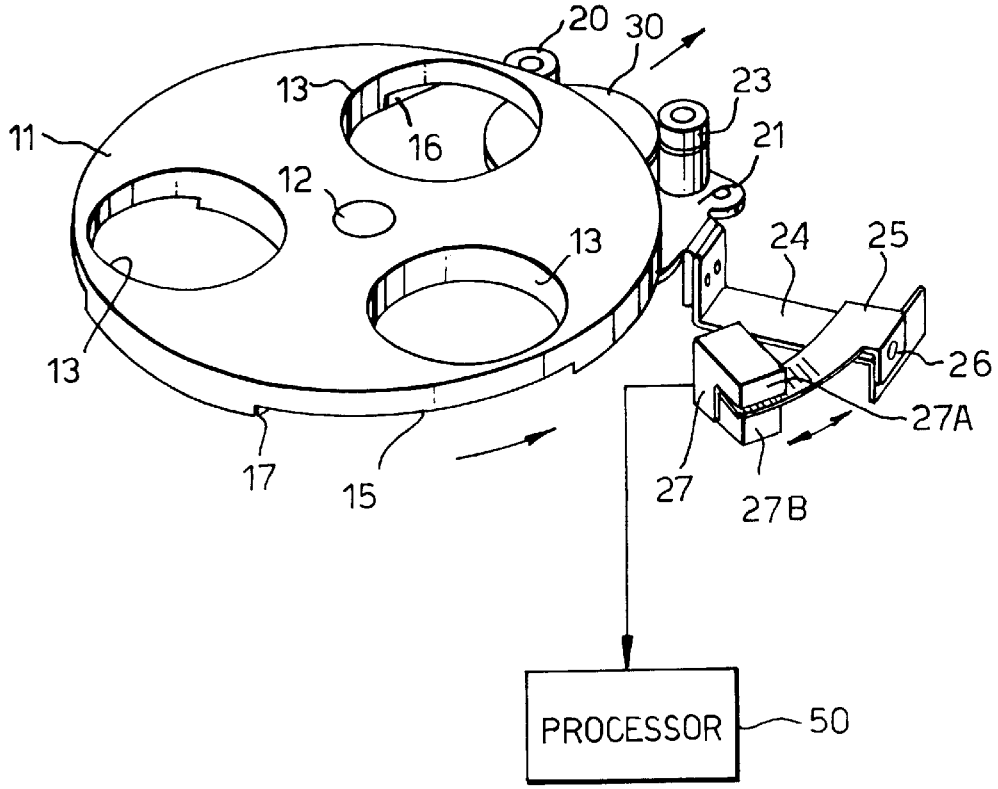
FIG. 1 is a perspective view of a portion of one embodiment according to the invention.

Referring to the drawings in particular, the invention comprises an apparatus for measuring a diameter of the disk body. The drawings show two embodiments of the apparatus wherein like reference numerals have been used to indicate like parts.

Figure 2:
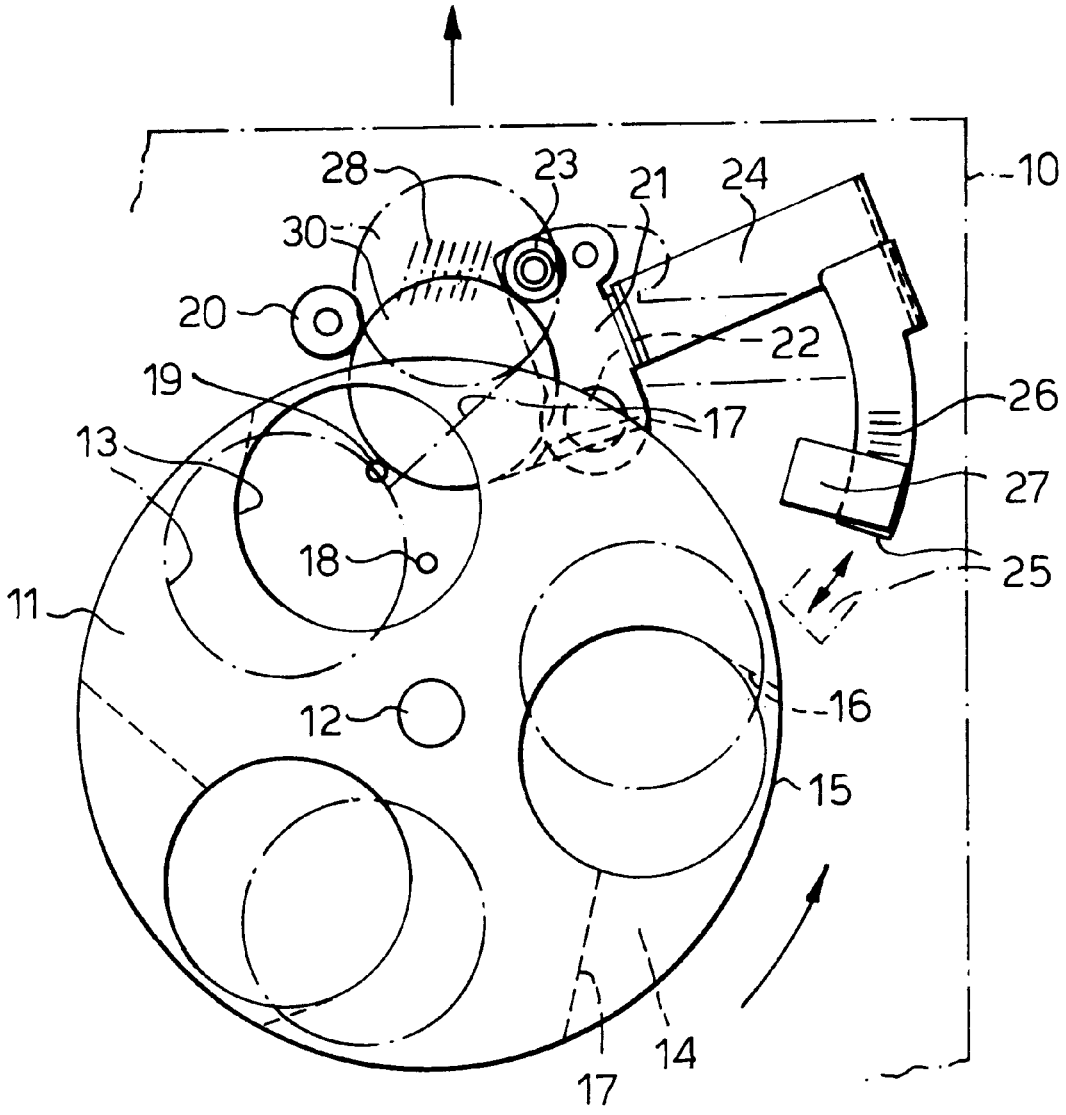
FIG. 2 is a plan view which shows the portion of the invention of FIG. 1.

The apparatus according to a first embodiment of the invention includes a part of base body with a big box form 10 which is shown in FIG. 2. The whole of this base body 10 is omitted from the drawings but it constitutes an apparatus for selecting disk bodies which have various diameters such as coins and so on.

The disk 11 of a big thick disk form which is shown at the center of FIG. 1 and FIG. 2 is fixed on the upper end part of a rotating axis 12 in the central part of the apparatus. The rotating axis 12 is a rotating axis connected to or part of a motor or similar drive (not shown) in the base body 10.

Three penetratable holes 13 are provided formed in the disk 11 at equal intervals. These holes 13 are opened near the peripheral part of disk 11 and store disk bodies 30 falling through a hopper (not shown) with a tubular shape from the top of FIG. 1 and FIG. 2. The disk bodies 30 have various diameters, and the penetrated hole 13 piles a plurality of disk bodies 30 and stores them.

Referring to FIG. 2, in the underside of the peripheral part of disk 11, three recesses 14 are provided. These recesses 14 have approximately a triangle plate form respectively. The recesses 14 are at equal intervals formed in the direction of the circumference of the disk 11.

FIG. 1 shows a narrow cutting (cut out or slot) 15 at this recess 14 which is a long side part of the triangle plate form is formed on the circumference edge of the thick disk 11.

The top part at the recess 14 opposite to this cutting 15 is formed to be communicated to the penetrated hole 13. Therefore, the recess 14 has two slender walls 16 and 17. Further, the shallow recess 14 is the size which can freely and slidably store only one of the disk bodies 30.

The operation of the apparatus according to the first embodiment of the invention is as follows.

When the disk bodies 30 which have various diameters are thrown into the apparatus, through the hopper (not shown) from the top (out of the paper in FIG. 1 and FIG. 2), the disk bodies 30 fall into either (any one) of the penetrated holes 13 in the disk 11 which the motor (not shown) turns counterclockwise.

The disk bodies 30 which fall into the penetrated holes 13 slide on the surface of base body 10 with counterclockwise rotation of the disk 11. Only one of the disk bodies 30 which are slide is pressed out from the penetrated hole 13 to the recess 14 by a guide pin 18 which is provided on or connected to the base body 10.

Moreover, when the disk 11 is rotated, only one of the disk bodies 30 is pressed out to the outside of disk 11 by means of a regulating pin 19 which is provided at the base body 10 and the wall 17 of the recess 14 (referring to the solid line disk body 30 of FIG. 2). When the disk 11 is rotated further, the disk body 30 is-pressed outside of the disk 11 only by the wall 17 at the recess 14 (referring to the chain line disk body 30 of FIG. 2).

Reference symbol 20 which is shown in the upper part of FIG. 1 and FIG. 2 is a small roller. This roller 20 is planted in the base body 10 at the outside of disk 11 near the regulating pin 19. Further, the fixed roller 20 provides means for guiding the above-mentioned pushed out disk body 30 and constitutes the apparatus which measures the diameter of disk bodies 30. The pins 18 and 19 are each attached on a leaf spring. The disk 11 has grooves on the bottom surface thereof to allow pins 18 and 19 to pass through the disk 11 when the disk is rotated.

Reference symbol 21 is a short arm. This arm 21 is provided at the inside of base body 10 and the one end is pivoted at 22. A small roller 23 is disposed in the other end of the arm 21 and moreover freely penetrated through a long hole (not shown) which is opened at the base body 10 and becomes free to move.

Further, this movable roller 23 is provided with an opposite position near the fixed roller 20. A little long arm 24 is provided. The base end of this arm 24 is fixed on the short arm 21. Therefore, the long arm 24 is provided within the inside of base body 10.

A slit plate 25 is provided having an arc form. This slit plate 25 is approximately normal to and fixed on the tip of the long arm 24 and a plurality of slits 26 are opened on the tip part. A photosensor 27 is provided. This sensor 27 senses the existence or nonexistence of the light through the moving slits 27. The photosensor 27 and slit plate 25 are disposed inside the base body 10 which is shown by the chain line.

A spring 28 is provided biasing the arm 21. This spring 28 provides the means for drawing the movable roller 23 to the direction of fixed roller 20. The movement of the movable roller 23 which depends on the spring 28 is regulated by a long hole (not shown).

According to this first embodiment of the invention, when a motor (not shown) is operated, the rotating axis 12 is rotated and also disk 11 is rotated. The disk body 30 is as the result pressed from the disk 11. The disk body 30 which is pressed out from the disk 11 is guided with the fixed roller 20 and simultaneously touches the movable roller 23. This condition is shown at the solid line disk 30 in FIG. 2.

Figure 3:
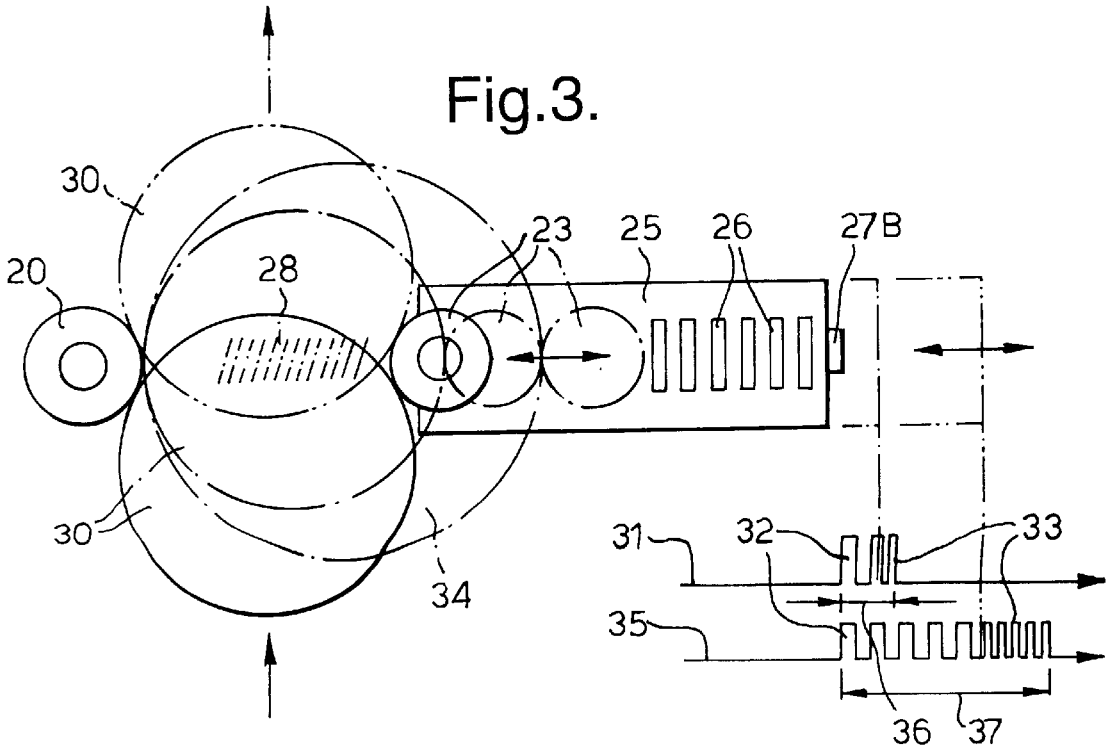
FIG. 3 is a partially schematic view of features of the invention to explain operation of the device of FIG. 2.

To facilitate description, the operation description of this embodiment refers to the schematic showing in FIG. 3. That is, in case of FIG. 2, the slit plate 25 rotates through the arms 21, 24 and the axis 22. However, to make a description simple, the slit plate 25 is illustrated at FIG. 3 as moving straight.

When the disk body 30 is pressed further outside by the disk 11, the disk body 30 is guided by the fixed roller 20 and presses out the movable roller 23 in opposition to the elasticity power in spring 28. This condition is shown at FIG. 2 and 3 respectively by the disk 30 of single-dot-and dash lines.

When the condition at the disk 30 of single-dot-and-dash line of FIG. 3 is passed through, in other words, when the condition which one pair of rollers 20 and 23 are on the diameter line of disk body 30 is passed through, the elasticity power in spring 28 acts and the disk body 30 is repelled further outside.

The spring 28 action and the condition immediately before the disk body 30 is repelled out is shown by a the disk 30 of double-dot-and-dash line of FIG. 3. As above mentioned, when the disk body 30 passes through between the one pair of rollers 20 and 23, a signal 31 (referring to the lower right of FIG. 3) is generated by a photodetector or photosensor by the movement of slits 26 relative to the fixed photosensor 27. For instance, when the slit plate 25 is moved to the position which is shown by the single-dot-and-dash line to the right direction by the pushing out of the disk body 30, one and half of pulses 32 having wide width forms are generated. Next, the spring 28 acts and, when the slit plate 25 moves to the left direction and reaches at the solid line position, one and half of pulses 33 having narrow width forms are generated.

In the same way, when a big disk body 34 (referring to FIG. 3) passes through between one pair of the rollers 20 and 23, a signal 35 is generated by the movement of a plurality of slits 26 and the fixed photosensor 27. In case of the big disk body 34, when the slit plate 25 is moved to the position which is shown by the double-dot-and-dash line to the right direction by the pushing out of the disk body 34, for instance, five pulses 32 with wide width forms are generated. Next, the spring 28 acts and, when the slit plate 25 moves to the left direction and reaches at the solid line position, for instance, five pulses 33 with narrow width forms are generated. As the result, by counting the number of pulses 32 with the wide width of the generated signal 31, the diameter of disk body 30, can be measured. Also, by counting the number of pulses 32 with the wide width of the signal 35, the diameter of big disk body 34 can be measured.

The counting may be by a suitable microprocessor or central processing unit. Further, the distinction of these wide width pulses 32 and narrow width pulses 33 and the calculation of wide width pulses 32 and so on depend on the means of the signal handling means (not shown) which is a central processing unit (CPU or a micro-processing unit (MPU).

In addition, the width 36 which is due to a plurality of pulses 32 and 33 which are in the signal 31 which is generated upon the passage of disk body 30 and the width 37 which is due to a plurality of pulses 32 and 33 which are in the signal 35 which is generated by the passage of disk body 34 are compared, and as the result, the diameters of disk bodies 30 and 34 may of course be measured.

Also, the fixed roller 20 may be a fixation member which has a pin and the like. The movable roller 23 is also permitted of course to be a movable member such as a plate with a pin, and the like. The spring 28 may be an elastic member such as a rubber ring or a plate spring, etc. Further, by making the diameters of rollers 20 and 23 big, these rollers contact each other and the stationary position of the movable roller 23 is regulated by a stopper and so on is not necessary. As the means for detecting the movement of movable roller 23, a lot of black lines on a transparent plate may be provided instead of a plurality of slits 26. In this case, the pulse numbers of signals 31 and 35 are increased and, as the result, the precision of the diameter measurement on the disk body 30 is naturally improved. Also, instead of the combination of the slits 26 and photosensor 27, the combination of a plurality of magnetic bodies and a magnetic sensor or the combination of a plurality of metallic bodies and a proximity switch or etc. is practicable as the means for detecting such as for detecting the movement of the movable member.

Figure 4:
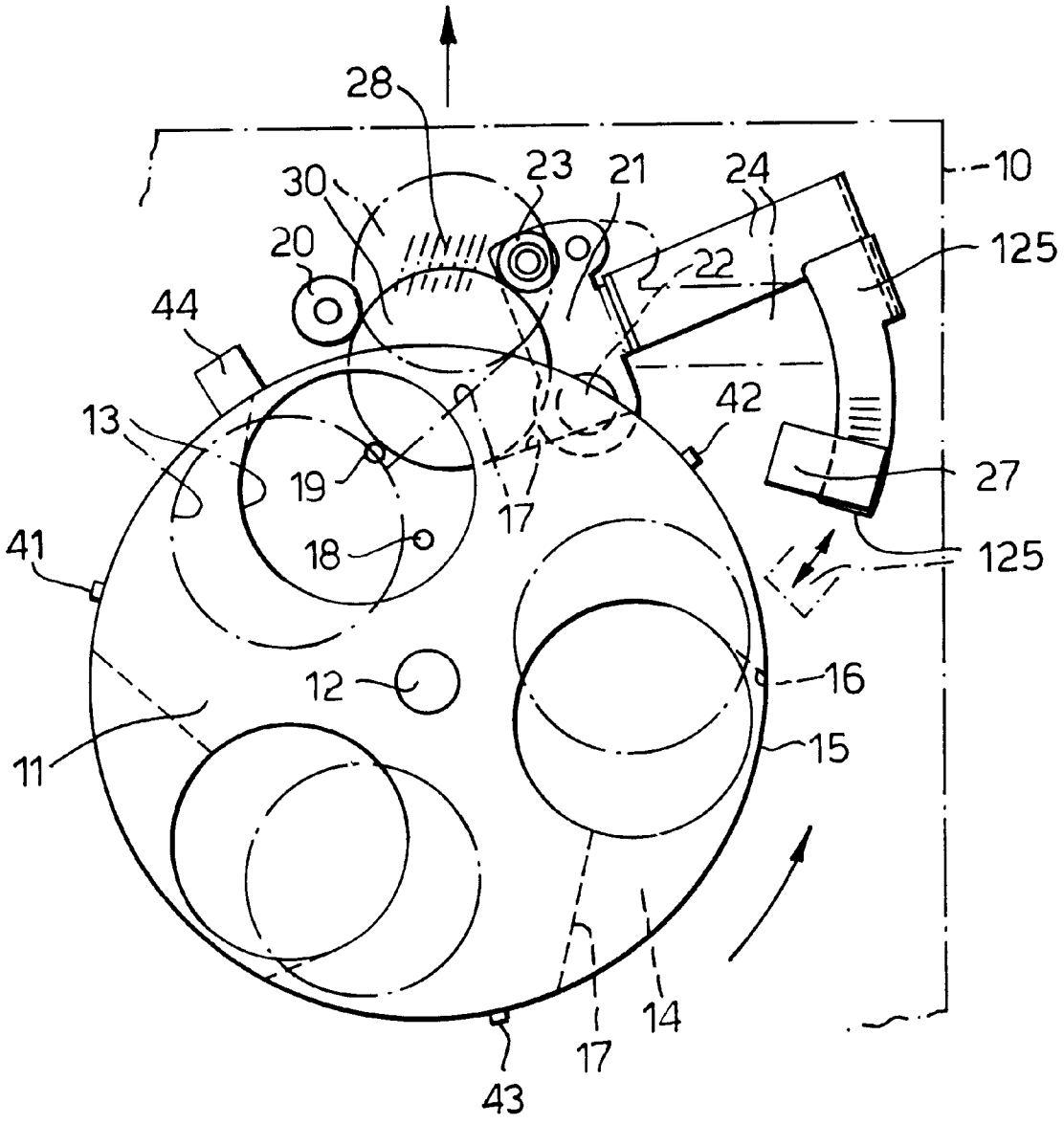
FIG. 4 is a plan view of a portion of another embodiment according to the invention.

Referring to the FIGS. 4 and 5, a second embodiment of the invention is shown including a part of a base body 10 with big box form. This base body 10 constitutes an apparatus to select the disk body which has a various diameter of the coin and so on. The illustration of the whole apparatus is omitted.

A big disk 11 is shown in FIG. 4 having a thick form, at the center thereof, is fixed to an outside of the upper end part of a rotating axes 12 such as a motor (not shown) within the base body 10. Three penetratable holes 13 which are opened at equal intervals near the periphery of disk 11 are provided to pile and to store disk bodies 30 which have various diameters. These disk bodies 30 fall through a pipe-shaped hopper (not shown) situated on FIG. 4 upwardly with respect to a plane of the paper.

In the peripheral underside of disk 11, three triangle plate-shaped recesses 14 are formed in the direction of the circumference and regular intervals. The slender cutting or cut out 15 which is the long side part of the triangle plate at this recess 14 is formed by the circumference edge of thick disk 11. The top part at the recess 14 which is opposite to this cutting 15 is formed to be communicated to the penetrated hole 13. Therefore, the recess 14 has two slender walls 16, 17. Further, the shallow recess 14 is the size figure which is inserted freely and can be slidably stored only a sheet of disk bodies 30.

The operation of the device is as follows:

Through the hopper which is omitted illustration, the disk bodies 30 which have various diameters are thrown into the device, from above the plane of FIG. 4. Then, the disk body 30 falls into in any of the penetrated holes 13 of disks 11 which is turned by the motor counterclockwise. The disk body 30 which falls into the penetrated hole 13 is moved in a sliding manner on a top surface of base body 10 upon rotation of the disk 11 counterclockwise.

Then, by action of the guide pin 18 which is disposed at the base body 10, only one of the disk bodies 30 is pushed out from the penetrated hole 13 to the recess 14. When the disk 11 is further rotated, by the regulating pin 19 which was disposed on the base body 10 and the wall 17 at the recess 14, only one of the disk bodies 30 is pressed out to the outside direction of the disk 11 (It refers to the disk 30 shown in solid line in FIG. 2). When the disk 11 is further rotated, this time, the disk body 30 is pushed outside from the disk 11, only by the wall 17 at the recess 14 (this is shown by the disk 30 shown in chain line in FIG. 4).

The upper portion of FIG. 4 shows a small roller 20, and this roller 20 is disposed in the base body 10 in the neighborhood of the regulating pin 19 and outside the disk 11. Further, this fixed roller 20 is the one to guide the above-mentioned pushed out disk body 30 and constitutes the apparatus which measures the diameter of disk body 30. Arm 21 is disposed inside the base body 10 and one end thereof is pivoted by an axis 22. Roller 23 is disposed at the other end of arm 21. This roller 23 is freely pierced and becomes movably in a long hole (not shown) which is opened by an upper plate of the base body 10. Furthermore, this movable roller 23 is oppositely disposed at the position near the fixed roller 20. A little long arm 24 is provided. The base end of this arm 24 is fixed on the short arm 21. Therefore, the long arm 24 is disposed inside the base body 10. A light shielding plate 25 is provided with an arc form and is projectingly fixed on the tip end of long arm 24 being approximately normal thereto. One slit may be opened at the tip part of shielding plate 25 from light. The photosensor 27 based on the intervening movement of the shielding plate 25, senses the existence or non-existence of the light. Further, the photosensor 27 and the shielding plate 25 are disposed inside the base body 10 which is shown by the chain line. On the upper portion of FIG. 4 a spring 28 is shown which is the one to draw the movable roller 23 to the direction of fixed roller 20. The movement of the movable roller 23 which depends on the spring 28 may be guided by a long hole (not shown), regardless of the rotation around the axis 22.

Figure 5A:
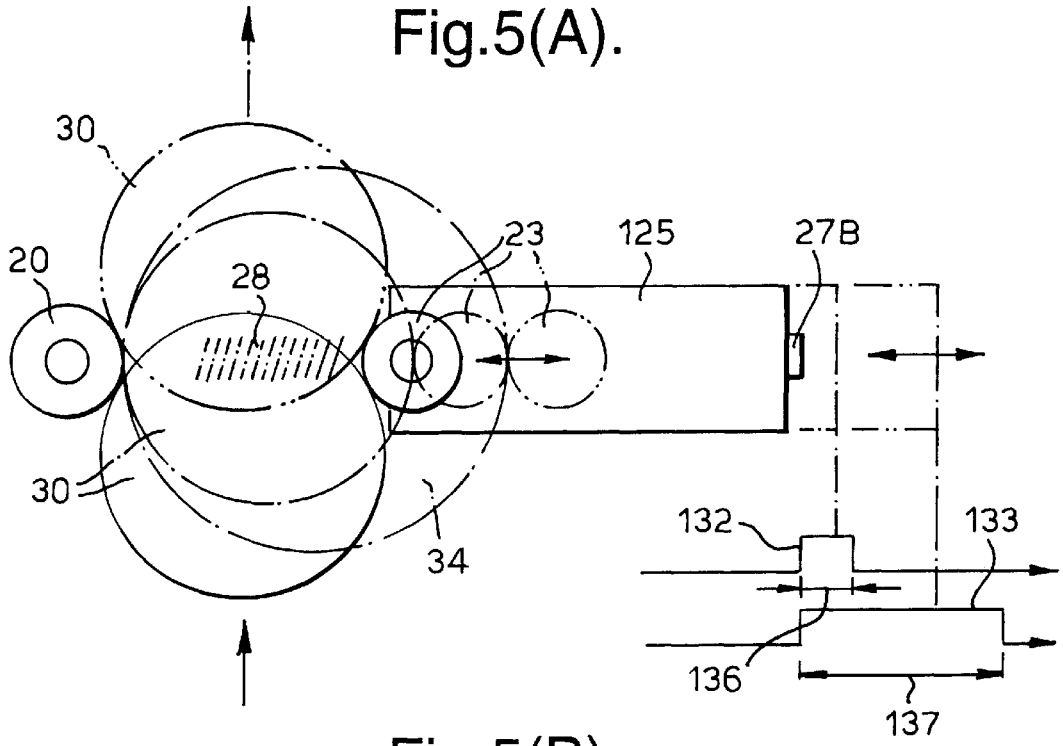
FIG. 5A is a partially schematic view of features of the invention to explain operation of the device of FIG. 5.

Referring to FIGS. 4 and 5A, three reference portions 41, 42, 43 are projectingly formed at equal intervals on the circumference surface of the disk 11. These reference portions 41–43 are detected by the photosensor 44 which is disposed on the base body 10 near the roller 20 and generate pulses 1, 2, 3 which become the standards or references such as doing a postscript. Further, as the means of the occurrence of standard pulses 1–3, an independent rotating plate (not shown) may also be arranged on the rotating axis 12 of the disk 11. Or, a rotating plate may be installed on the motor (not shown) that rotates the disk 11. The disk 11 is turned with the rotating axis 12 turned when the motor is operated and the disk bodies 30 are pushed out from the disk 11. The disk body 30 which is pressed from the disk 11 is first guided with the fixed roller 20 and then touches the movable roller 23. This condition of disk 30 is shown in the solid line in FIG. 4.

FIG. 5A shows a condition of FIG. 4 schematically, taking out only the necessary portions in case of the operation description. In FIG. 4, the slit plate 125 is rotated through the arms 21, 24 and the axis 22. However, to make a description simple in FIG. 5A, the slit plate 25 is illustrated as having a straight line movement.

When the disk body 30 is pressed more outside by the disk 11, the disk body 30 is guided by the fixed roller 20 and moved, and the movable roller 23 against the spring 28 is pushed out to the right of the drawings. This condition of the disk 30 is shown respectively in the single-dot-and-dash line in FIG. 4 and FIG. 5A.

When the condition of the disk 30 shown in single-dot-and-dash line is passed, that is, when the one pair of rollers 20, 23 is passed on the diameter line of the disk body 30, the spring 28 acts and then the disk body 30 is snapped out, moved further outwardly. The instantaneous condition of the disk 30, after the spring 28 acts and before the disk body 30 is snapped out, is shown in the single-dot-and-dash line on FIG. 5A. Therefore, when the disk body 30 is passed between the one pair of rollers 20, 23, a pulse 32 (referring to the lower right in FIG. 5A) is generated by the moved shielding plate 25 from light and the fixed photosensor 27. That is, at FIG. 5A, the shielding plate 25 from light is moved to the position in the right direction which is shown in the single-dot-and dash line by the pushing out of the disk body 30.

Then, next, the spring 28 acts with the passage of disk body 30, the light shielding plate 25 is moved to the left direction and returns to the solid line position, and the pulse 32 is generated as the result. In the same way, when the big disk body 34 is passed between the one pair of rollers 20, 23, a pulse 33 (referring to the lower right of FIG. 5A) is generated by the moved shielding plate 25 from light and fixed photosensor 27.

Figure 5B:
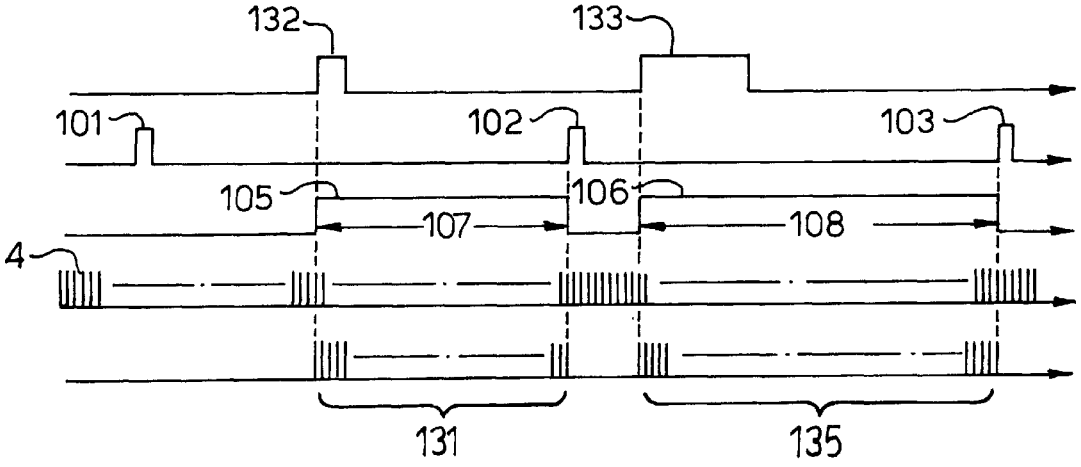
FIG. 5B is a signal diagram to explain operation of the device of FIG. 5.

In case of the big disk body 34, the shielding plate 25 from light is moved to the position which is shown in the double-dot-and-dash line at the right side of the drawing by the pushing out of the disk body 34. Next, the spring 28 acts with the passage of disk body 34 and, the light shielding plate 25 is moved to the left direction and returns to the solid line position, and the pulse 33 is generated as the result. Therefore, using the difference between the width 36 of the pulse 32 which is generated by the passage of small disk body 30 and the width 37 of the pulse 33 which is generated by the passage of large disk body 34, the diameter of large and small disk bodies 30, 34 can be measured. On the other hand, by the three reference portions 41–43 and photosensor 44 which are shown in FIG. 4, the pulses 1, 2, 3 are generated which become the standard or reference. By the combination of these standard pulses 1–3 and above-mentioned pulses 32, 33, the long pulse 5 which corresponds to the small disk body 30 is generated, and the longer pulse 6 which corresponds to the big disk body 34 is generated (as shown in FIG. 5B).

Therefore, as same as above-mentioned, using the difference between the width 7 of the pulse 5 which is generated by the passage of the small disk body 30 and the width 8 of the pulse 6 which is generated by the passage of big disk body 34, the diameter of large and small disk bodies 30, 34 can be measured. On the other hand, the signal of the high frequency pulse train 4 may be generated from the motor (not shown), by the well-known means of installing an encoder plate on the rotating axis. Also, when the motor is a brushless motor, the signal of pulse train 4 may be easily generated by a magnetic sensor. Also, with regard to the installation of the encoder plate on the rotating axis 12, a signal of high frequency pulse train 4 is generated.

When taking a logic product of these pulses 5, 6 and pulse train 4, accordingly, the signal which has the pulse trains 31, 35 which corresponded to the pulse width 7, 8 is generated (FIG. 5A). By counting the number of the pulses of the pulse train 31, as the result, the diameter of small disk body 30 can be measured. Also, by counting the pulse number of the pulse train 35, the diameter of the big disk body 34 can be measured. The signal handling means is provided for signal handling such as the distinction of the above-mentioned large width pulse and the small width pulse, the logic product of these pulse signals, and the calculation of the pulse number. The signal handling means includes a CPU which is a central processing unit or a MPU which is a microprocessing unit, or the like.

On the other hand, the rotating speed of the disk 11 depends on the turning speed of the motor of the illustration abbreviation. From this fact, even if the pulse widths 7, 8 changes by such as the disk 11 is loaded, the pulse distance of the pulse train 4 also changes, it is because that the load of disk 11 influences the motor. Therefore, the number of the pulse trains 31, 35 within the pulse width 7, 8 becomes always constant. In other words, even if the rotating speed of the disk 11 changes, the diameters of the disk bodies 30, 34 are correctly measured. In addition, the fixed roller 20 may be a fixed member which has a pin and so on, and also the movable roller 23 is may be a movable member such as a plate that has a pin. The spring 28 is permitted to be an elasticity member such as a rubber ring or a plate spring. Moreover, when making the diameters of rollers 20, 23 big beforehand, these contact each other. Therefore, the provision of stationary position of the movable roller 23 being regulated at the stopper isn't necessary. Also, instead of the photosensors 27, 44, means for detecting such as magnetic sensors, proximity switches and the like is also practicable.

The detection apparatus of the first embodiment of this invention which was mentioned above has an effect that it is possible to add simply to the structure of the actuator of the coin sending-out apparatus and so on. Also, by calculating the number of the pulses which depend on the diameter of the pushed out disk body, this invention has an advantage that the diameter can be simply and correctly measured. When the number of the pulses which is generated by the detection means is increased, the disk body can be more precisely measured.

In addition, since the apparatus may be added in a simple manner according to this invention the whole apparatus is small and simple.

As for the second embodiment of invention which was mentioned above, it provides a simple detection means to the structure of the actuator of the coin and so on only resulting in the desirable effect that the diameter of the pushed out disk body can be simply measured. The diameter of the disk body can be simply measured on the basis of temporal length of on and off, i.e. the size of pulse width, by the detection means of this invention. Moreover, when this invention is combined to the high frequency pulse signal which is generated from the means for pushing out a disk body, the desirable result is attained that the diameter of the disk body can be precisely measured. Also because the constitution to add is simple, the big advantage is achieved that the whole apparatus becomes small and simple.

While specific embodiments of the invention have been shown and described in detail to illustrate the application of the principles of the invention, it will be understood that the invention may be embodied otherwise without departing from such principles.

What is claimed is:

1. An apparatus for measuring a diameter of the disk body comprising:

a fixed member for guiding a pushed-out disk body;

a movable member which is movable opposing said fixed member and comes into contact with said pushed-out disk body;

an elasticity member for urging said movable member toward the direction of said fixed member; and detecting means for detecting the movement of said movable member, said detecting means includes a single sensor generating a single detection signal representative of a plurality of different diameters of the disk body, said detection means includes a photosensor.

2. The apparatus according to claim 1, further comprising:

signal handling means for processing said detection signal and for measuring the diameter of the said disk body based on said signal.

3. The apparatus according to claim 1, wherein:

said fixed member has a small roller.

4. The apparatus according to claim 1, wherein said movable member has a small roller.

5. An apparatus for measuring a disk body diameter comprising:

a rotating body for pushing out a disk body;

a fixed member for guiding the disk body which is pushed out;

a movable member movable opposite to said fixed member and contacting said disk body which is pushed out;

an elasticity member for drawing this movable member to the direction of the said fixed member; and movement detection means for detecting the movement of said movable member.

6. The apparatus according to claim 5, further comprising:

angle of rotation detecting means for detecting a rotated angle of said rotating body; and processor means for processing signals generated by said movement detection means and said angle of rotation detection means to measure the diameter of said disk body.

7. The apparatus according to claim 5, wherein said fixed member has a small roller.

8. The apparatus according to claim 5, wherein said movable member has a small roller.

9. The apparatus according to claims 5, wherein said detection means has a photosensor.

10. An apparatus for measuring a diameter of the disk body comprising:

a rotating body for holding at least one disk body and for pushing out the disk body;

a fixed member for guiding a pushed-out disk body;

a movable member which is movable opposing said fixed member and comes into contact with said pushed-out disk body;

an elasticity member for urging said movable member toward a direction of said fixed member; and movement detection means for detecting the movement of said movable member.

11. An apparatus according to claim 10, further comprising:

angle of rotation detection means for detecting a rotated angle of the rotating body; and processor means for processing signals generated by said movement detection means and said angle of rotation detection means to measure the diameter of said disk body.

12. The apparatus according to claim 10, further comprising:

signal handling means, said detecting means generating a detection signal, said signal handling means for processing said detection signal and for measuring the diameter of the disk body based on said signal.

13. An apparatus in accordance with claim 10, wherein:

said movement detection means includes a slit plate defining a plurality of slits and connected to said movable member, said movement detection means also includes a sensor detecting movement of said plurality of slits moving past said sensor.

14. An apparatus in accordance with claim 13, further comprising processor means for counting a number of slits detected by said sensor.

15. An apparatus in accordance with claim 13, wherein:

said elasticity member moves the one disk body away from said fixed member faster than said rotating body pushes the one disk body out;

a processor means is connected to said sensor for counting a number of slits detected by said sensor and for determining a speed of said slits moving past said sensor, said processor determines a diameter of the one disk body from said number of slits and said speed.

16. An apparatus in accordance with claim 10, wherein:

said movement detection means includes a sensor generating a pulse with a duration dependent on a magnitude and a speed of movement of said movable member.

17. An apparatus in accordance with claim 10, wherein:

a base with a deflection member is provided on one side of said rotating body;

said rotating body is mounted for rotation on said base and has a circumferentially closed hole extending therethrough for receiving the disk body and a recess facing said base and extending from the circumferentially closed hole to a parameter of the rotating body, the rotating body is mounted relative to said base such that the disk body to be pushed-out is slidably supported on said base within said recess, and wherein the rotating body cooperates with said deflection member to push the disk body between said fixed and movable members, such that said movable member moves by an amount relative to the diameter of the disk body.

18. An apparatus according to claim 17, wherein:

said fixed member and said movable member are positioned radially outwardly from said rotating body, co-planar with the recess such that when the disk body is pushed from the circumferentially closed hole to the parameter of the rotating body, via said recess, further rotation of the rotatable member causes the disk body to be pushed between said fixed and movable members.

* * * * *